US007438189B2

(12) United States Patent
Garner et al.

(10) Patent No.: US 7,438,189 B2
(45) **Date of Patent: *Oct. 21, 2008**

(54) BITUMINOUS FROTH INCLINED PLATE SEPARATOR AND HYDROCARBON CYCLONE TREATMENT PROCESS

(75) Inventors: William Nicholas Garner, Fort McMurray (CA); Donald Norman Madge, Calgary (CA); William Lester Strand, Edmonton (CA)

(73) Assignee: Suncor Energy, Inc., Fort McMurray, Alberta (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/360,489

(22) Filed: Feb. 24, 2006

(65) Prior Publication Data

US 2006/0138036 A1 Jun. 29, 2006

Related U.S. Application Data

(62) Division of application No. 10/306,003, filed on Nov. 29, 2002, now Pat. No. 7,141,162.

(51) Int. Cl.
*C10G 1/00* (2006.01)
*B03B 9/02* (2006.01)

(52) U.S. Cl. ..... 209/164; 209/12.1; 209/727; 209/729; 210/202; 210/512.1; 210/521; 208/390; 208/391; 208/425; 208/426; 208/428

(58) Field of Classification Search ..... 209/12.1, 209/164, 727, 729; 208/390, 391, 425, 426, 208/428; 210/202, 512.1, 521
See application file for complete search history.

(56) References Cited

U.S. PATENT DOCUMENTS

| | | | | |
|---|---|---|---|---|
| 2,910,424 | A | | 10/1959 | Tek et al. |
| 3,607,720 | A | | 9/1971 | Paulson |
| 3,808,120 | A | * | 4/1974 | Smith ..... 208/391 |
| 3,956,417 | A | | 5/1976 | Franz et al. |
| 3,962,070 | A | | 6/1976 | Stotler |
| 3,971,718 | A | | 7/1976 | Reid |
| 3,972,861 | A | | 8/1976 | Gardner, Jr. et al. |
| 4,017,263 | A | | 4/1977 | Holmes et al. |

(Continued)

FOREIGN PATENT DOCUMENTS

CA 518320 11/1955

(Continued)

OTHER PUBLICATIONS

Related pending U.S. Appl. No. 11/360,597, filed Feb. 24, 2006. Title: Bituminous Froth Hydrocarbon Cyclone. Inventors: Garner et al.

(Continued)

*Primary Examiner*—Thomas M Lithgow
(74) *Attorney, Agent, or Firm*—Knobbe, Martens, Olson & Bear, LLP

(57) ABSTRACT

An apparatus for separating bitumen from a bitumen froth output of a oil sands hot water extraction process comprises an inclined plate separator (IPS) for providing a first bitumen separation stage and a cyclone for providing a second bitumen separation stage. The cyclone overflow is recycled to the IPS inlet.

8 Claims, 3 Drawing Sheets

U.S. PATENT DOCUMENTS

| | | | | |
|---|---|---|---|---|
| 4,035,282 | A | | 7/1977 | Stuchberry et al. |
| 4,036,664 | A | | 7/1977 | Priebe |
| 4,072,609 | A | | 2/1978 | Kizior |
| 4,090,943 | A | | 5/1978 | Moll et al. |
| 4,139,646 | A | | 2/1979 | Gastrock |
| 4,146,534 | A | | 3/1979 | Armstrong |
| 4,216,796 | A | | 8/1980 | Gastrock |
| 4,279,743 | A | | 7/1981 | Miller |
| 4,337,143 | A | | 6/1982 | Hanson et al. |
| 4,383,914 | A | | 5/1983 | Kizior |
| 4,397,741 | A | | 8/1983 | Miller |
| 4,399,027 | A | | 8/1983 | Miller |
| 4,514,305 | A | * | 4/1985 | Filby ..... 210/703 |
| 4,545,892 | A | | 10/1985 | Cymbalisty et al. |
| 4,556,422 | A | | 12/1985 | Reynolds et al. |
| 4,581,142 | A | | 4/1986 | Fladby et al. |
| 4,604,988 | A | | 8/1986 | Rao |
| 4,744,890 | A | | 5/1988 | Miller et al. |
| 4,838,434 | A | | 6/1989 | Miller et al. |
| 4,851,123 | A | | 7/1989 | Mishra |
| 4,859,317 | A | * | 8/1989 | Shelfantook et al. ..... 208/391 |
| 4,914,017 | A | | 4/1990 | Mifune |
| 4,994,097 | A | | 2/1991 | Brouwers |
| 5,032,275 | A | | 7/1991 | Thew |
| 5,035,910 | A | | 7/1991 | Jones et al. |
| 5,037,558 | A | | 8/1991 | Kalnins |
| 5,055,202 | A | | 10/1991 | Carroll et al. |
| 5,062,955 | A | | 11/1991 | Sciamanna |
| 5,071,556 | A | | 12/1991 | Kalnins et al. |
| 5,071,557 | A | | 12/1991 | Schubert et al. |
| 5,073,177 | A | | 12/1991 | Brouwers |
| 5,090,498 | A | | 2/1992 | Hamill |
| 5,110,471 | A | | 5/1992 | Kalnins |
| 5,118,408 | A | | 6/1992 | Jansen et al. |
| 5,143,598 | A | | 9/1992 | Graham et al. |
| 5,207,805 | A | | 5/1993 | Kalen et al. |
| 5,223,148 | A | | 6/1993 | Tipman et al. |
| 5,242,580 | A | | 9/1993 | Sury |
| 5,242,604 | A | | 9/1993 | Young et al. |
| 5,264,118 | A | | 11/1993 | Cymerman et al. |
| 5,302,294 | A | | 4/1994 | Schubert et al. |
| 5,316,664 | A | | 5/1994 | Gregoli et al. |
| 5,340,467 | A | | 8/1994 | Gregoli et al. |
| 5,350,525 | A | | 9/1994 | Shaw et al. |
| 5,556,545 | A | | 9/1996 | Volchek et al. |
| 5,620,594 | A | | 4/1997 | Smith et al. |
| 5,667,543 | A | | 9/1997 | Brouwers |
| 5,667,686 | A | | 9/1997 | Schubert |
| 5,711,374 | A | | 1/1998 | Kjos |
| 5,740,834 | A | | 4/1998 | Sherowski |
| 5,840,198 | A | | 11/1998 | Clarke |
| 5,879,541 | A | | 3/1999 | Parkinson |
| 5,958,256 | A | | 9/1999 | Ocel, Jr. et al. |
| 5,996,690 | A | | 12/1999 | Shaw et al. |
| 6,077,433 | A | | 6/2000 | Brun Henriksen et al. |
| 6,119,870 | A | | 9/2000 | Maciejewski et al. |
| 6,189,613 | B1 | | 2/2001 | Chachula et al. |
| 6,197,095 | B1 | | 3/2001 | Ditria et al. |
| 6,213,208 | B1 | | 4/2001 | Skilbeck |
| 6,322,845 | B1 | | 11/2001 | Dunlow |
| 6,346,069 | B1 | | 2/2002 | Collier |
| 6,378,608 | B1 | | 4/2002 | Nilsen et al. |
| 6,398,973 | B1 | | 6/2002 | Saunder et al. |
| 6,468,330 | B1 | | 10/2002 | Irving et al. |
| 7,141,162 | B2 | | 11/2006 | Garner et al. |
| 2001/0005986 | A1 | | 7/2001 | Matsubara et al. |
| 2001/0042713 | A1 | | 11/2001 | Conrad et al. |
| 2002/0018842 | A1 | | 2/2002 | Dunlow |
| 2002/0068673 | A1 | | 6/2002 | Comer |
| 2002/0068676 | A1 | | 6/2002 | Collier |
| 2002/0148777 | A1 | | 10/2002 | Tuszko |

FOREIGN PATENT DOCUMENTS

| | | | |
|---|---|---|---|
| CA | 970308 | | 7/1975 |
| CA | 1026252 | * | 2/1978 |
| CA | 1059052 | | 7/1979 |
| CA | 1066644 | | 11/1979 |
| CA | 1072473 | | 2/1980 |
| CA | 1097574 | | 3/1981 |
| CA | 1126187 | | 6/1982 |
| CA | 1138822 | | 4/1983 |
| CA | 1194622 | | 1/1985 |
| CA | 1201412 | | 3/1986 |
| CA | 1254171 | | 5/1989 |
| CA | 1267860 | * | 4/1990 |
| CA | 2000984 | | 4/1991 |
| CA | 2037856 | | 9/1991 |
| CA | 1283465 | | 12/1991 |
| CA | 2024756 | | 5/1992 |
| CA | 1305390 | | 7/1992 |
| CA | 2058221 | | 7/1992 |
| CA | 1318273 | | 5/1993 |
| CA | 1322177 | | 9/1993 |
| CA | 1325180 | | 12/1993 |
| CA | 2088227 | | 4/1994 |
| CA | 2108521 | | 4/1994 |
| CA | 2086073 | | 6/1994 |
| CA | 2155198 | | 8/1994 |
| CA | 2184613 | | 11/1995 |
| CA | 2180686 | | 2/1997 |
| CA | 2231543 | | 3/1997 |
| CA | 2263691 | | 3/1998 |
| CA | 2249679 | | 4/1999 |
| CA | 2308410 | | 5/1999 |
| CA | 2236183 | | 10/1999 |
| CA | 2246841 | | 3/2000 |
| CA | 2365008 | | 8/2000 |
| CA | 2298122 | | 7/2001 |
| CA | 2090618 | | 10/2001 |
| CA | 2358805 | | 10/2001 |
| CA | 2311738 | | 11/2001 |
| CA | 2409129 | | 11/2001 |
| CA | 2315596 | | 2/2002 |
| CA | 2332207 | | 2/2002 |
| CA | 857306 | | 3/2002 |
| CA | 873854 | | 3/2002 |
| CA | 882667 | | 3/2002 |
| CA | 910271 | | 3/2002 |
| CA | 2217300 | | 8/2002 |
| CA | 2455623 | * | 7/2005 |
| CN | 1112033 | | 11/1995 |
| EP | 262916 | | 6/1988 |
| EP | 355127 | | 6/1989 |
| EP | 332641 | | 3/1994 |
| EP | 605746 | | 7/1994 |
| GB | 195055 | | 1/1924 |
| GB | 726841 | | 3/1955 |
| GB | 814610 | | 6/1959 |
| GB | 1302064 | | 1/1973 |
| GB | 2047735 | | 1/1980 |
| GB | 2075543 | | 11/1981 |
| GB | 2116447 | | 9/1983 |
| JP | 61082856 | | 4/1986 |
| WO | WO 94/23823 | | 10/1994 |
| WO | WO 00/74815 | | 12/2000 |

OTHER PUBLICATIONS

Related pending U.S. Appl. No. 11/486,302, filed Jul. 13, 2006. Title: Bituminous Froth Inclined Plate Separator and Hydrocarbon Cyclone Treatment Process. Inventors: Garner et al.

Related pending U.S. Appl. No. 11/759,151, filed Jun. 6, 2007. Title: System and Process for Concentrating Hydrocarbons in a Bitumen Feed. Inventors: Garner et al.

Related pending U.S. Appl. No. 11/595,817, filed Nov. 9, 2006. Title: System, Apparatus and Process for Extraction of Bitumen From Oil Sands. Inventors: Bjornson et al.

National Energy Board, Canada's Oil Sands: A Supply and Market Outlook to 2015, An Energy Market Assessment Oct. 2000.

Krebs' Engineers, Krebs D-Series gMAX DeSanders for Oil and Gas, Bulletin 11-203WEL, no date.

Eva Mondt "Compact Centrifugal Separator of Dispersed Phases" Proefschrift, Dec. 2005.

Natural Resources Canada, Treatment of Bitumen Froth and Slop Oil Tailings, Dec. 2001.

Rimmer, Gregoli and Yildlrim, "Hydrocyclone-based Process for Rejecting Solids from Oil Sands at the Mine Site While Retaining Bitumen for Transportation to a Processing Plant"; Suncor Extraction 3rd f1 pp. 93-100, Paper delivered on Monday Apr. 5, 1993 at a conference in Alberta, Canada entitled "Oil Sands—Our Petroleum Future".

* cited by examiner

BITUMINOUS FROTH INCLINED PLATE SEPARATOR AND HYDROCARBON CYCLONE TREATMENT PROCESS

CROSS REFERENCE TO PRIOR APPLICATIONS

This is a division of U.S. application Ser. No. 10/306,003, filed on Nov. 29, 2002, now U.S. Pat. No. 7,141,162 which claims priority from Canadian patent application no. 2,400,258 filed on Sep. 19, 2002.

FIELD OF THE INVENTION

This invention relates to bitumen recovery from oil sand and more particularly to a treatment process for the removal of water and mineral from the product produced in a primary oil sand bitumen extraction process.

BACKGROUND OF THE INVENTION

Oil sands are a geological formation, which are also known as tar sands or bituminous sands. The oil sands deposits provide aggregates of solids such as sand, clay mineral plus water and bitumen—a term for extra heavy oil. Significant deposits of oil sands are found in Northern Alberta in Canada and extend across an area of more than thirteen thousand square miles. The oil sands formation extends from the surface or zero depth to depths of two thousand feet below overburden. The oil sands deposits are measured in billions of barrels equivalent of oil and represent a significant portion of the worldwide reserves of conventional and non-conventional oil reserves.

The oil sands deposits are composed primarily of particulate silica mineral material. The bitumen content varies from about 5% to 21% by weight of the formation material, with a typical content of about 12% by weight. The mineral portion of the oil sands formations generally includes clay and silt ranging from about 1% to 50% by weight and more typically 10% to 30% by weight as well as a small amount of water in quantities ranging between 1% and 10% by weight. The in-situ bitumen is quite viscous, generally has an API gravity of about 6 degrees to 8 degrees and typically includes 4% to 5% sulfur with approximately 38% aromatics.

The Athabasca oil sands are bitumen-bearing sands, where the bitumen is isolated from the sand by a layer of water forming a water-wet tar sand. Water-wet tar sand is almost unique to the Athabasca oil sands and the water component is frequently termed connate water. Sometimes the term water-wet is used to describe this type of tar sand to distinguish it from the oil-wet sand deposits found more frequently in other tar sand formations and in shale deposits including those oily sands caused by oil spills.

The extraction of the bitumen from the sand and clay-like mineral material is generally accomplished by heating the composition with steam and hot water in a rotating vessel or drum and introducing an extraction agent or process aid. The process aid typically is sodium hydroxide NaOH and is introduced into the processing to improve the separation and recovery of bitumen particularly when dealing with difficult ores. The hot water process is carried out in a vessel called a separator cell or more specifically a primary separator vessel (PSV) after the oil sand has been conditioned in the rotating drum.

The PSV process produces a primary bitumen froth gathered in a launder from the upper perimeter of the vessel; a mineral tailings output from the lower portion of the vessel and a middlings component that is removed from the midportion of the vessel. It has been found that production of the middlings component varies with the fines and clay content of the originating oil sand and is described more fully, for example in Canadian patent 857,306 to Dobson. The middlings component contains an admixture of bitumen traces, water and mineral material in suspension. The middlings component is amenable to secondary separation of the bitumen it contains, by introducing air into the process flow in flotation cells. The introduced air causes the bitumen to be concentrated at the surface of the flotation cell. The flotation of the bitumen in preference to the solids components permits the air entrained bitumen to be extracted from the flotation cell. Flotation of the air-entrained bitumen from the process flow is sometimes termed differential flotation. The air-entrained bitumen froth is also referred to as secondary froth and is a mixture of the bitumen and air that rises to the surface of the flotation cell. Typically, the secondary froth may be further treated, for example by settling, and is recycled to the PSV for reprocessing.

Further treatment of the primary bitumen froth from the PSV requires removal of the mineral solids, the water and the air from the froth to concentrate the bitumen content. Conventionally, this is done by the use of centrifuges. Two types of centrifuge systems have heretofore been deployed. One, called a solids-bowl centrifuge has been used to reduce the solids in froth substantially. To remove water and solids from the froth produced by a solids-bowl centrifuge; a secondary centrifuge employing a disk has been used. Disk centrifuges are principally de-watering devices, but they help to remove mineral as well. Examples of centrifuge systems that have been deployed are described in Canadian patents 873,854; 882,667; 910,271 and 1,072,473. The Canadian patent 873,854 to Baillie for example, provides a two-stage solid bowl and disk centrifuge arrangement to obtain a secondary bitumen froth from the middlings stream of a primary separation vessel in the hot water bitumen recovery process. The Canadian patent 882,667 to Daly teaches diluting bitumen froth with a naphtha diluent and then processing the diluted bitumen using a centrifuge arrangement.

Centrifuge units require an on-going expense in terms of both capital and operating costs. Maintenance costs are generally high with centrifuges used to remove water and solid minerals from the bitumen froth. The costs are dictated by the centrifuges themselves, which are mechanical devices having moving parts that rotate at high speeds and have substantial momentum. Consequently, by their very nature, centrifuges require a lot of maintenance and are subject to a great deal of wear and tear. Therefore, elimination of centrifuges from the froth treatment process would eliminate the maintenance costs associated with this form of froth treatment. Additional operating cost results from the power cost required to generate the high g-forces in large slurry volumes.

In the past, cyclones of conventional design have been proposed for bitumen froth treatment, for example in Canadian patents 1,026,252 to Lupul and 2,088,227 to Gregoli. However, a basic problem is that recovery of bitumen always seems to be compromised by the competing requirements to reject water and solids to tailings while maintaining maximum hydrocarbon recovery. In practice, processes to remove solids and water from bitumen have been offset by the goal of maintaining maximal bitumen recovery. Cyclone designs heretofore proposed tend to allow too much water content to be conveyed to the overflow product stream yielding a poor bitumen-water separation. The arrangement of Lupul is an example of use of off-the-shelf cyclones that accomplish high bitumen recovery, unfortunately with low water rejection. The low water rejection precludes this configuration from being of use in a froth treatment process, as too much of the water in the feed stream is passed to the overflow or product stream.

A hydrocyclone arrangement is disclosed in Canadian patent 2,088,227 to Gregoli. Gregoli teaches alternative arrangements for cyclone treatment of non-diluted bitumen froth. The hydrocyclone arrangements taught by Gregoli attempt to replace the primary separation vessel of a conventional tar sand hot water bitumen processing plant with hydrocyclones. The process arrangement of Gregoli is intended to eliminate conventional primary separation vessels by supplanting them with a hydrocyclone configuration. This process requires an unconventional upgrader to process the large amounts of solids in the bitumen product produced by the apparatus of Gregoli. Gregoli teaches the use of chemical additive reagents to emulsify high bituminous slurries to retain water as the continuous phase of emulsion. This provides a low viscosity slurry to prevent the viscous plugging in the hydrocyclones that might otherwise occur. Without this emulsifier, the slurry can become oil-phase continuous, which will result in several orders of magnitude increase in viscosity. Unfortunately, these reagents are costly making the process economically unattractive.

Another arrangement is disclosed in Canadian patent 2,029,756 to Sury, which describes an apparatus having a central overflow conduit to separate extracted or recovered bitumen from a froth fluid flow. The apparatus of Sury is, in effect, a flotation cell separator in which a feed material rotates about a central discharge outlet that collects a launder overflow. The arrangement of Sury introduces process air to effect bitumen recovery and is unsuitable for use in a process to treat deaerated naphtha-diluted-bitumen froth as a consequence of explosion hazards present with naphtha diluents and air.

Other cyclone arrangements have been proposed for hydrocarbon process flow separation from gases, hot gases or solids and are disclosed for example in Canadian patents 1,318,273 to Mundstock et al; 2,184,613 to Raterman et al and in Canadian published patent applications 2,037,856; 2,058,221; 2,108,521; 2,180,686; 2,263,691, 2,365,008 and the hydrocyclone arrangements of Lavender et al in Canadian patent publications 2,358,805, 2,332,207 and 2,315,596.

SUMMARY OF THE INVENTION

In the following narrative wherever the term bitumen is used the term diluted bitumen is implied. This is because the first step of this froth treatment process is the addition of a solvent or diluent such as naphtha to reduce viscosity and to assist hydrocarbon recovery. The term hydrocarbon could also be used in place of the word bitumen for diluted bitumen.

In one aspect, the invention provides an apparatus for separating bitumen from a bitumen feed comprising a mixture of bitumen, water and mineral, the apparatus comprising:

an inclined plate separator (IPS) for providing a first bitumen separation stage, the IPS having an inlet for receiving the bitumen feed, an overflow outlet for providing a first bitumen rich stream separated from the feed, and an underflow outlet for providing a first bitumen lean stream;

a cyclone for providing a second bitumen separation stage, the cyclone having an inlet coupled to the underflow outlet of the IPS for receiving the IPS underflow, an overflow outlet for providing a second bitumen rich stream and an underflow outlet for providing a second bitumen lean stream;

wherein the cyclone overflow outlet is coupled to the IPS inlet for recycling the second bitumen rich stream from the cyclone to the IPS.

In further aspect, the invention provides a process for separating bitumen from a bitumen feed comprising a mixture of bitumen, water and mineral, the process comprising:

a) supplying the bitumen feed to an inclined plate separator (IPS) to produce an IPS overflow comprising a first bitumen rich stream and an IPS underflow comprising a first bitumen lean stream;

b) supplying the IPS underflow to a cyclone to produce a cyclone overflow comprising a second bitumen rich stream and a cyclone underflow comprising a second bitumen lean stream; and, c) recycling the cyclone overflow for blending with the feed to the IPS.

In a further aspect, the present invention provides a bitumen froth process circuit that uses an arrangement of hydrocarbon cyclones and inclined plate separators to perform removal of solids and water from the bitumen froth that has been diluted with a solvent such as naphtha. The process circuit has an inclined plate separator and hydrocarbon cyclone stages. A circuit configured in accordance with the invention provides a process to separate the bitumen from a hybrid emulsion phase in a bitumen froth. The hybrid emulsion phase includes free water and a water-in-oil emulsion and the circuit of the present invention removes minerals such as silica sand and other clay minerals entrained in the bitumen froth and provides the removed material at a tailings stream provided at a circuit tails outlet. The process of the invention operates without the need for centrifuge equipment. The elimination of centrifuge equipment through use of hydrocarbon cyclone and inclined plate separator equipment configured in accordance with the invention provides a cost saving in comparison to a process that uses centrifuges to effect bitumen de-watering and demineralization. However, the process of the invention can operate with centrifuge equipment to process inclined plate separator underflow streams if so desired.

In one aspect, the apparatus of the invention provides an inclined plate separator (IPS) which operates to separate a melange of water-continuous and oil-continuous emulsions into a cleaned oil product and underflow material that is primarily a water-continuous emulsion. The cyclone apparatus processes a primarily water-continuous emulsion and creates a product that constitutes a melange of water-continuous and oil-continuous emulsions separable by an IPS unit. When the apparatus of the invention is arranged with a second stage of cyclone to process the underflow of a first stage cyclone, another product stream, separable by an IPS unit can be created along with a cleaned tails stream.

In accordance an aspect of the invention, the bitumen froth to be treated is supplied to a circuit inlet for processing into a bitumen product provided at a circuit product outlet and material removed from the processed bitumen froth is provided at a circuit tails outlet. The bitumen froth is supplied to a primary inclined plate separator (IPS) stage, which outputs a bitumen enhanced overflow stream and a bitumen depleted underflow stream. The underflow output stream of the first inclined plate separator stage is a melange containing a variety of various emulsion components supplied as a feed stream to a cyclone stage. The cyclone stage outputs a bitumen enhanced overflow stream and a bitumen depleted underflow stream. The formation of a stubborn emulsion layer can block the downward flow of water and solids resulting in poor bitumen separation. These stubborn emulsion layers are referred to as rag-layers. The process of the present invention is resistant to rag-layer formation within the inclined plate separator stage, which is thought to be a result of the introduction of a recycle feed from the overflow stream of the hydrocarbon cyclone stage.

The material of the recycle feed is conditioned in passage through a hydrocarbon cyclone stage. When the recycle material is introduced into the inclined plate separator apparatus, a strong upward bitumen flow is present even with moderate splits. Static deaeration, that is removal of entrained air in the froth without the use of steam, is believed to be another factor that promotes enhanced bitumen-water separation within the inclined plate separators. A bitumen froth that has been deaerated without steam is believed to have increased free-water in the froth mixture relative to a steam deaerated froth, thus tending to promote a strong water flow in the underflow direction, possibly due to increased free-water in the new feed. In a process arranged in accordance with this invention distinct rag-layers are not manifested in the compression or underflow zones of the IPS stages.

The underflow output stream of the first inclined plate separator stage is supplied to a primary hydrocarbon cyclone stage, which transforms this complex mixture into an emulsion that is available from the primary cyclone stage as an overflow output stream. In a preferred arrangement, the overflow output stream of the primary cyclone stage is supplied to an IPS stage to process the emulsion. The overflow output stream of an IPS stage provides a bitumen product that has reduced the non-bitumen components in an effective manner.

The hydrocarbon cyclone apparatus of the present invention has a long-body extending between an inlet port and a cyclone apex outlet, to which the output underflow stream is directed, and an abbreviated vortex finder to which the output overflow stream is directed. This configuration permits the cyclone to reject water at a high percentage to the underflow stream output at the apex of the cyclone. This is accomplished in process conditions that achieve a high hydrocarbon recovery to the overflow stream, which is directed to the cyclone vortex finder, while still rejecting most of the water and minerals to the apex underflow stream. Mineral rejection is assisted by the hydrophilic nature of the mineral constituents. The cyclone has a shortened or abbreviated vortex finder, allowing bitumen to pass directly from the input bitumen stream of the cyclone inlet port to the cyclone vortex finder to which the output overflow stream is directed. The long-body configuration of the cyclone facilitates a high water rejection to the apex underflow. Thus, the normally contradictory goals of high hydrocarbon recovery and high rejection of other components are simultaneously achieved.

The general process flow of the invention is to supply the underflow of an inclined plate separator stage to a cyclone stage. To have commercial utility, it is preferable for the cyclone units to achieve water rejection. Water rejection is simply the recovery of water to the underflow or reject stream.

In addition to the unique features of the hydrocarbon cyclone apparatus the process units of this invention interact with each other in a novel arrangement to facilitate a high degree of constituent material separation to be achieved. The bitumen froth of the process stream emerging as the cyclone overflow is conditioned in passage through the cyclone to yield over 90% bitumen recovery when the process stream is recycled to the primary inclined plate separator stage for further separation. Remarkably, the resultant water rejection on a second pass through the primary cyclone stage is improved over the first pass. These process factors combine to yield exceptional bitumen recoveries in a circuit providing an alternate staging of an inclined plate separator stage and a cyclone stage where the bitumen content of the output bitumen stream from the circuit exceeds 98.5% of the input bitumen content. Moreover, the output bitumen stream provided at the circuit product outlet has a composition suitable for upgrader processing.

Other aspects and features of the present invention will become apparent to those ordinarily skilled in the art upon review of the following description of specific embodiments of the invention in conjunction with the accompanying figures.

DETAILED DESCRIPTION OF THE INVENTION

Figure 1:
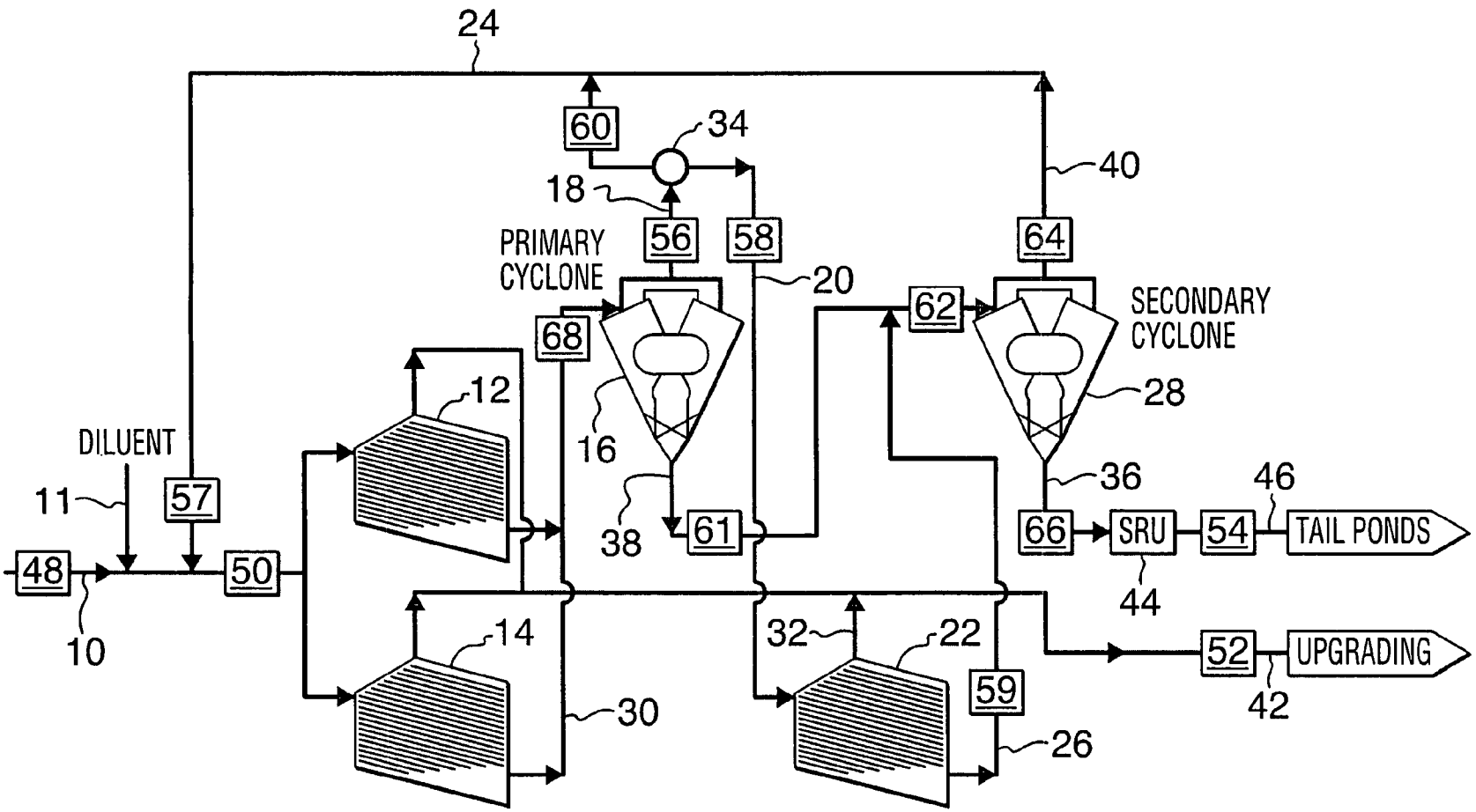
FIG. 1 is a schematic diagram depicting a preferred arrangement of apparatus adapted to carry out the process of the invention.

FIG. 1 is a schematic diagram depicting the arrangement of apparatus adapted to carry out the process of the invention. The schematic diagram provides an outline of the equipment and the process flows, but does not include details, such as pumps, that provide the ability to transport the process fluids from one unit to the next. The apparatus of the invention includes inclined plate separator (IPS) stage units and cyclone stage units, each of which process an input stream to produce an overflow output stream, and an underflow output stream. The IPS overflow output stream has a bitumen enriched content resulting from a corresponding decrease in solids, fines and water content relative to the bitumen content of the IPS input stream. The IPS underflow output stream has solids, fines and water with a depleted bitumen content relative to the IPS input stream. The IPS underflow output stream may be referred to as a bitumen depleted stream. The cyclone stage overflow output stream has a bitumen enriched content resulting from a corresponding decrease in solids, fines and water content relative to the bitumen content of the cyclone input stream. The cyclone underflow output stream has solids, fines and water with a depleted bitumen content relative to the cyclone input stream. The cyclone underflow output stream may be referred to as a bitumen depleted stream.

While the process flows and apparatus description of the invention made with reference to FIG. 1 refers to singular units, such as a cyclone 16 or 28, a plurality of cyclone units are used in each stage where process scale requires. For example, for production rates in excess of 200,000 bbl/day of bitumen, cyclone units are arranged in parallel groups of 30 or more with each cyclone unit bearing about 200 gal/min of flow. In the general arrangement of the apparatus adapted to carry out the process, inclined plate separator (IPS) units are alternately staged with cyclone units such that an IPS stage underflow feeds a cyclone stage, while a cyclone stage overflow feeds an IPS stage. The mutual conditioning of each stage contributes to the remarkable constituent separation performance obtained by the unit staging of this process.

The processing circuit has a circuit inlet 10 to receive a process feed stream 48. The process feed stream is a bitumen froth output of an oil sands extraction process and is diluted at 11 with a suitable solvent, for example naphtha, or a paraffinic or alkane hydrocarbon solvent. Naphtha is a mixture of aromatic hydrocarbons that effectively dissolves the bitumen constituent of the bitumen froth feed stream 48 supplied via line 10 to produce bitumen froth with a much-reduced viscosity. The addition of a solvent partially liberates the bitumen from the other components of the bitumen froth feed stream 48 by reducing interfacial tensions and rendering the composition more or less miscible. The diluted bitumen feed stream 50 including a recycle stream 57 is supplied to a primary IPS stage comprising IPS units 12 and 14 shown as an example of multiple units in a process stage. The overflow output stream 52 of the primary IPS stage is supplied as a product stream, which is sent to the circuit product outlet line 42 for downstream processing, for example at an upgrader plant.

The underflow output stream of the primary IPS stage is supplied via line 30 as the feed stream 68 to a primary hydrocarbon cyclone stage (HCS) comprising for example, a primary cyclone 16. The hydrocarbon cyclone processes a feed stream into a bitumen enriched overflow stream and a bitumen depleted underflow stream. The overflow output stream 56 of the primary cyclone stage on line 18 is directed for further processing depending on the setting of diverter valve 34. Diverter valve 34 is adjustable to direct all or a portion of the primary HCS overflow output stream 56 to a recycle stream 60 that is carried on line 24 to become recycle stream 57 or a part of it. Recycle stream 57 is supplied to the primary IPS stage. The portion of the primary HCS overflow output stream that is not directed to recycle stream 60 becomes the secondary IPS feed stream 58 that is delivered to a secondary IPS stage 22 via line 20. Naturally diverter valve 34 can be set to divert the entire HCS overflow stream 56 to the secondary IPS feed stream 58 to the limit of the secondary IPS capacity.

The circuit bitumen froth feed stream 48 will have varying quantities or ratios of constituent components of bitumen, solids, fines and water. The quantities or ratios of the component of froth feed stream 48 will vary over the course of operation of the circuit depending on the composition of the in situ oil sands ore that are from time to time being mined and processed. Adjustment of diversion valve 34 permits the processing circuit flows to be adjusted to accommodate variations in oil sands ore composition, which is reflected in the composition of the bitumen froth feed stream 48. In this manner, the circuit process feed flow 50 to the primary cyclone stage can be set to adapt to the processing requirements providing optimal processing for the composition of the bitumen froth feed. In some circumstances, such as when the capacity of the secondary IPS stage 22 is exceeded, all or a portion of the primary cyclone stage overflow stream 56 on line 18 is directed to recycle stream 60 by diverter valve 34. Recycle stream 60 is carried on line 24 to form part of the recycle stream 57 supplied to the primary IPS stage IPS units 12 and 14. However, the composition of stream 48 is nearly invariant to the composition of mine run ore over a wide range of ores that might be fed to the upstream extraction process.

The preferred embodiment of a process circuit in accordance with the principles of the invention preferably includes secondary IPS processing equipment interconnecting with the primary processing equipment by means of diverter valve 34. Where the entire overflow output stream of the primary stage is recycled back to the primary IPS stage, the primary IPS stage process acts as a secondary IPS stage and no stream is supplied to the secondary IPS stage for processing. However, a secondary IPS stage is preferably provided to accommodate the variations in composition of the feed froth stream 48 encountered in operation of the process. Secondary IPS unit 22 processes the feed stream 58 received from the overflow of the primary cyclone stage into a bitumen enriched secondary IPS overflow output stream on line 32 and a bitumen depleted secondary IPS underflow output stream 59 on line 26. The recovered bitumen of the secondary IPS overflow stream on line 32 is combined with the overflow stream of the primary IPS stage to provide the circuit output bitumen product stream 52 delivered to the circuit product outlet line 42 for downstream processing and upgrading.

The secondary stage IPS 22 underflow output stream 59 is supplied by line 26 where it is combined with the primary cyclone underflow stream 61 to provide a feed stream 62 to a secondary stage cyclone 28. The secondary hydrocarbon cyclone stage (HCS) 28 processes input feed stream 62 into a bitumen enriched secondary HCS overflow output stream 64 on line 40 and a bitumen depleted secondary HCS underflow output stream 66 on line 36. The secondary HCS underflow output stream 66 is directed to a solvent recovery unit 44, which processes the stream to produce the circuit tailings stream 54 provided to the circuit tails outlet 46 of the circuit. The operating process of the secondary HCS 28 is varied during the operation of the process. The operating process of the secondary HCS 28 is optimized to reduce the bitumen content of the secondary HCS underflow output stream 66 to achieve the target bitumen recovery rate of the process. Preferably, the operation of the secondary HCS is maintained to achieve a hydrocarbon content in the secondary HCS underflow output stream 66 that does not exceed 1.6%. Preferably, a solvent recovery unit 44 is provided to recover diluent present in the secondary HCS underflow output stream 66. Solvent recovery unit (SRU) 44 is operated to maintain solvent loss to the tailings stream 54 below 0.5% to 0.7% of the total solvent fed to the circuit on line 11. The tailings stream 54 is sent for disposal on the circuit tails outlet line 46.

The primary and secondary HCS cyclone units achieve a so-called ternary split in which a high hydrocarbon recovery to the output overflow stream is obtained with a high rejection of solids and water reporting to the output underflow stream. In a ternary split, even the fines of the solids are rejected to a respectable extent.

The primary HCS cyclone unit 16 receives the underflow output stream on line 30 from the primary IPS stage IPS units 12, 14 as an input feed stream 68. The primary hydrocarbon cyclone 16 processes feed stream 68 to obtain what is referred to herein as a ternary split. The hydrocarbon and other constituents of the cyclone feed stream are reconstituted by the hydrocarbon cyclone 16 so as to enable the primary HCS overflow output stream on line 18 to be supplied, via line 20, as a feed stream 58 to a secondary IPS stage unit 22. This process flow obtains a ternary split, which achieves a high bitumen recovery. The process within primary HCS cyclone unit 16 involves a complex transformation or re-conditioning of the received primary IPS underflow output stream 68. The primary HCS underflow output stream 61 is passed via line 38 to become part of the feed stream 62 of secondary HCS cyclone unit 28 and yield further bitumen recovery. Further bitumen recovery from the secondary HCS overflow output stream 64 is obtained by recycling that stream on line 40 back to the primary IPS stage for processing.

The closed loop nature of the recycling of this process reveals an inner recycling loop, which is closed through line 26 from the secondary IPS stage and an outer recycling loop, which is closed through line 40 from the secondary HCS. These recycle loops provide a recycle stream 57 which contains material from the primary and secondary HCS and the bitumen recovered from this recycle material is called second-pass bitumen. Remarkably the second-pass bitumen in recycle stream 57 is recovered in the primary IPS stage at greater than 90% even though the bitumen did not go to product in the first pass through the primary IPS stage. Thus, the arrangement provides a cyclic process in which the overflow stream of a HCS is reconditioned by an IPS stage and the underflow stream of an IPS stage is reconditioned by a HCS. In this way, the individual process stages recondition their overflow streams in the case of cyclone stages and their underflow streams in the case of IPS stages for optimal processing by other downstream stages in the process loops. In the HCS cyclone units, the flow rates and pressure drops can be varied during operation of the circuit. The HCS unit flow rates and pressure drops are maintained at a level to achieve the performance stated in Tables 1 and 2. An input stream of a cyclone is split to the overflow output stream and the underflow output stream and the operating flow rates and pressure drops will determine the split of the input stream to the output streams. Generally, the range of output overflow split will vary between about 50% to about 80% of the input stream by varying the operating flow rates and pressure drops.

Table 1 provides example compositions of various process streams in the closed-loop operation of the circuit.

TABLE 1

| Stream | Bitumen | Mineral | Water | Solvent | Coarse | Fines | Hydrocarbon |
|---|---|---|---|---|---|---|---|
| 48 New feed | 55.00 | 8.50 | 36.50 | 00.00 | 3.38 | 5.12 | 55.00 |
| 50 IPS feed | 34.95 | 5.95 | 41.57 | 17.52 | 2.17 | 3.78 | 52.48 |
| 52 Product | 63.51 | 0.57 | 2.06 | 33.86 | 0.00 | 0.57 | 97.37 |
| 54 Tails | 1.02 | 17.59 | 80.98 | 0.59 | 7.42 | 10.17 | 1.61 |

Table 2 lists process measurements taken during performance of process units arranged in accordance with the invention. In the table, the Bitumen column is a hydrocarbon with zero solvent. Accordingly, the Hydrocarbon column is the sum of both the Bitumen and Solvent columns. The Mineral column is the sum of the Coarse and the Fines columns. These data are taken from a coherent mass balance of operational data collected during demonstration and operational trials. From these trials it was noted that water rejection on the HCS is over 50%. It was also noted that the nominal recovery of IPS stage is about 78%, but was boosted to over 85% by the recycle. All of the stages in the circuit operate in combination to produce a recovery of bitumen approaching 99% and the solvent losses to tails are of the order of 0.3%.

TABLE 2

Unit Operations Performance of Hydrocarbon Cyclones and Inclined Plate Separators in Closed Loop

| Unit Process | Unit Hydrocarbon Recovery | Unit Water Rejection | Unit Solids Rejection | Fines Rejection |
|---|---|---|---|---|
| Primary IPS | 78% | 98% | 97% | |
| Primary Cyclone | 85% | 55% | 78% | |
| Secondary Cyclone | 85% | 54% | 82% | |
| Recycle or Secondary IPS | 91% | 98.5% | 95.5% | |
| Overall Recovery | 99.2% Bitumen<br>99.7% Solvent | | | |
| Product Spec | | 2.0% H2O | | 0.57% Mineral<br>0.32% non-bituminous hydrocarbon (NBHC) |

Figure 2:
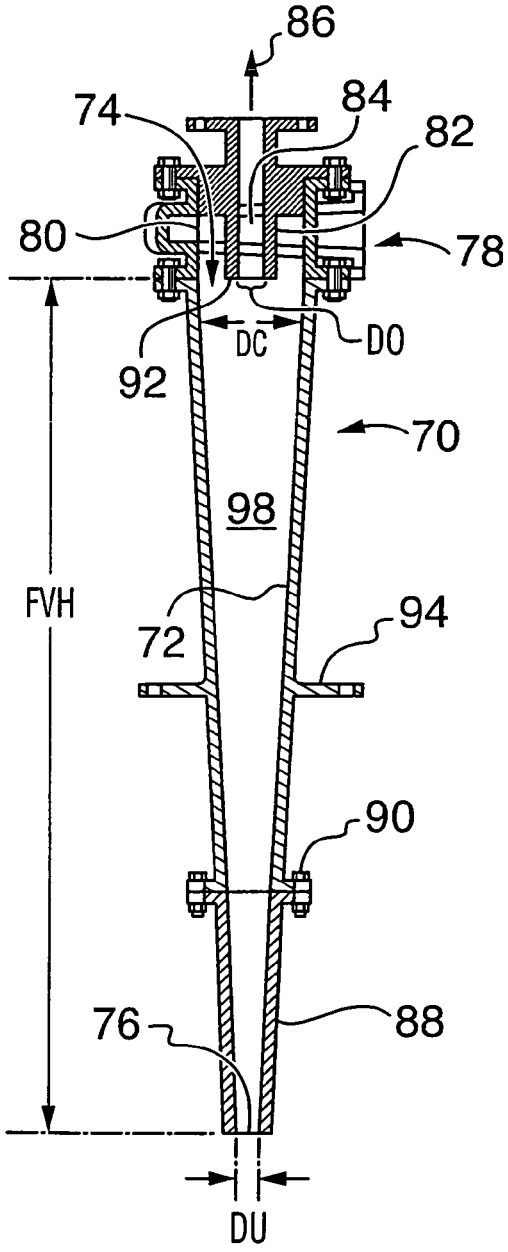
FIG. 2 is an elevation cross-section view of a preferred embodiment of a cyclone.

FIG. 2 shows an elevation cross-section of a preferred embodiment of the hydrocarbon cyclone apparatus depicting the internal configuration of the cyclone units. The cyclone 70 defines an elongated conical inner surface 72 extending from an upper inlet region 74 to an outlet underflow outlet 76 of lower apex 88. The cyclone has an upper inlet region 74 with an inner diameter DC and an upper overflow outlet 84 of a diameter DO at the vortex finder 82 and an underflow outlet 76 at the lower apex, which has a diameter DU. The effective underflow outlet diameter 76 at the lower apex 88 of the cyclone is also referred to as a vena cava. It is somewhat less than the apex diameter due to the formation of an up-vortex having a fluid diameter called the vena cava. The fluid flows near the lower apex 88 of a cyclone are shown in FIG. 3*a*. The cyclone has a free vortex height FVH extending from the lower end 92 of the vortex finder to the vena cava of the lower apex 88. The fluid to be treated is supplied to the cyclone via input channel 78 that has an initial input diameter DI. The input channel 78 does not need to have a uniform cross-section along its entire length from the input coupling to the cyclone inlet 80. The fluid to be treated is supplied under pressure to obtain a target velocity within the cyclone when the fluid enters the cyclone through cyclone inlet 80. Force of gravity and the velocity pressure of the vortex urge the fluid composition entering the cyclone inlet downward toward apex 76. An underflow fluid stream is expelled through the lower apex 76. The underflow stream output from the cyclone follows a generally helical descent through the cyclone cavity. The rate of supply of the fluid to be treated to the cyclone 70 causes the fluid to rotate counter-clockwise (in the northern hemisphere) within the cyclone as it progresses from the upper inlet region 74 toward the underflow exit of lower apex 76. Variations in density of the constituent components of the fluid composition cause the lighter component materials, primarily the bitumen component, to be directed toward vortex finder 82 in the direction of arrow 86.

As depicted in FIG. 3*a*, when the cyclone is operating properly the fluid exits the apex of they cyclone as a forced spray 89 with a central vapour core 97 extending along the axis of the cyclone. Near the apex 76 a central zone subtended by the vena cava 91 is formed. The vena cava is the point of reflection or transformation of the descending helix 93 into an ascending helix 95. Contained within this hydraulic structure will be an air core or vapour core 97 supported by the helical up and down vortices. This structure is stable above certain operating conditions, below which the flow is said to rope. Under roping conditions the air core and the up-vortex will collapse into a tube of fluid that will exit downward with a twisting motion. Under these circumstances the vortex flow will cut off and there will be zero separation. Roping occurs when the solids content of the underflow slurry becomes intolerably high.

The vortex finder 82 has a shortened excursion where the vortex finder lower end 92 extends only a small distance below cyclone inlet 80. A shortened vortex finder allows a portion of the bitumen in the inlet stream to exit to the overflow output passage 84 without having to make a spiral journey down into the cyclone chamber 98 and back up to exit to the overflow output passage 84. However, some bitumen in the fluid introduced into the cyclone for processing does make this entire journey through the cyclone chamber to exit to the overflow output passage 84. The free vortex height FVH, measured from the lower end of the vortex finder 92 to the underflow outlet 76 of lower apex 88, is long relative to the cyclone diameters DI and DO. Preferably, a mounting plate 94 is provided to mount the cyclone, for example, to a frame structure (not shown).

Preferably the lower portion 88 of the cyclone is removably affixed to the body of the cyclone by suitable fasteners 90, such as bolts, to permit the lower portion 88 of the cyclone to be replaced. Fluid velocities obtained in operation of the cyclone, cause mineral materials that are entrained in the fluid directed toward the lower apex underflow outlet 76 to be abrasive. A removable lower apex 88 portion permits a high-wear portion of the cyclone to be replaced as needed for operation of the cyclones. The assembly or packaging of the so-called cyclopac has been designed to facilitate on-line replacement of individual apex units for maintenance and insertion of new abrasion resistant liners.

Figure 3:
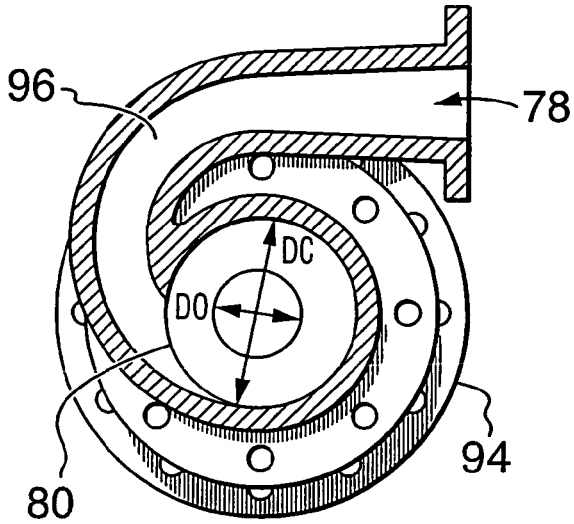
FIG. 3 is a top cross-section view of the cyclone of FIG. 2.
Figure 3A:
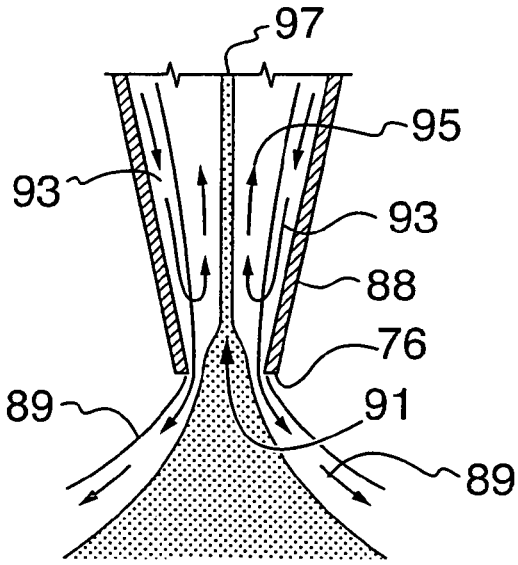
FIG. 3*a* is an enlarged cross-section view of a portion of an operating cyclone.

FIG. 3 shows a top view cross-section of the cyclone of FIG. 2. The cyclone has an injection path 96 that extends from the input channel 78 to the cyclone inlet 80. Various geometries of injection path can be used, including a path following a straight line or a path following a curved line. A path following a straight line having an opening into the body of the cyclone that is tangential to the cyclone is called a Lupul Ross cyclone. In the preferred embodiment, the injection path 96 follows a curved line that has an involute geometry. An involute injection path assists in directing the fluid supplied to the cyclone to begin to move in a circular direction in preparation for delivery of the fluid through cyclone inlet 80 into the chamber 98 of the cyclone for processing. The counter-clockwise design is for use in the northern hemisphere in order to be in synch with the westerly coriolis force. In the southern hemisphere this direction would be reversed.

In the preferred embodiment of the cyclone, the dimensions listed in Table 3 are found:

TABLE 3

| | Path | DI | DC | DO | DU | FVH | ABRV |
|---|---|---|---|---|---|---|---|
| Primary Cyclone | Involute | 50 mm | 200 mm | 50 mm | 40 mm | 1821 mm | 102 mm |
| Secondary Cyclone | Involute | 50 mm | 150 mm | 50 mm | 50 mm | 1133 mm | 105 mm |
| Lupul Ross Cyclone | Tangent | 9.25 mm | 64 mm | 19 mm | 6.4 mm | 181 mm | 32 mm |

Where:

Path: is the injection path length geometry. If the path is an involute, the body diameter DC: is a parameter of the involute equation that defines the path of entry into the cyclone DI: is the inlet diameter at the entry of the fluid flow to the cyclone DC: is the body diameter of the cyclone in the region of entry into the cyclone DO: is the overflow exit path vortex finder diameter or the outlet pipe diameter DU: is the underflow exit path apex diameter at the bottom of the cyclone, also called the vena cava FVH: is the free vortex height or the distance from the lower end of the vortex finder to the vena cava ABRV: is the distance from the centre-line of the inlet flow path to the tip of the vortex finder. The shorter this distance the more abbreviated is the vortex finder.

The cyclones are dimensioned to obtain sufficient vorticity in the down vortex so as to cause a vapor core 97 in the centre of the up-vortex subtended by the vena cava. The effect of this vapor core is to drive the solvent preferentially to the product stream, provided to the overflow output port 84, thereby assuring minimum solvent deportment to tails or underflow stream, provided to the underflow outlet 76 of lower apex. This is a factor contributing to higher solvent recovery in the process circuit. At nominal solvent ratios the vapor core is typically only millimeters in diameter, but this is sufficient to cause 3% to 4% enrichment in the overhead solvent to bitumen ratio.

A workable cyclone for use in processing a diluted bitumen froth composition has a minimum an apex diameter of 40 mm to avoid plugging or an intolerably high fluid vorticity. An apex diameter below 40 mm would result in high fluid tangential velocity yielding poor life expectancy of the apex due to abrasion even with the most abrasion resistant material. Consequently, a Lupul Ross cyclone design is undesirable because of the small size of openings employed.

The embodiments of the primary and secondary cyclones of the dimensions stated in Table 3 sustain a small vapour core at flow rates of 180 gallon/min or more. This causes enrichment in the solvent content of the overflow that is beneficial to obtaining a high solvent recovery. The vapour core also balances the pressure drops between the two exit paths of the cyclone. The long body length of these cyclones fosters this air core formation and assists by delivering high gravity forces within the device in a manner not unlike that found in centrifuges, but without the moving parts. In the preferred embodiment of the primary cyclone, the upper inlet region has an inner diameter of 200 mm. The injection path is an involute of a circle, as shown in FIG. 3. In one and one half revolutions prompt bitumen can move into the vortex finder and exit to the overflow output passage 84 if the solvent to bitumen ratio is properly adjusted. The internal dimensions of the secondary cyclones are similar and the same principles apply as were stated in relation to the primary cyclones. However, the diameter of the body of the secondary cyclone is 150 mm to create a higher centrifugal force and a more prominent vapour core. The dimensions of the secondary cyclone are aimed at producing minimum hydrocarbon loss to tails. This is accomplished with as low as 15% hydrocarbon loss, which still allows for a water rejection greater than 50%.

The IPS units 12,14 and 22 of the IPS stages are available from manufacturers such as the Model SRC slant rib coalescing oil water separator line of IPS equipment manufactured by Parkson Industrial Equipment Company of Florida, U.S.A.

Figure 4:
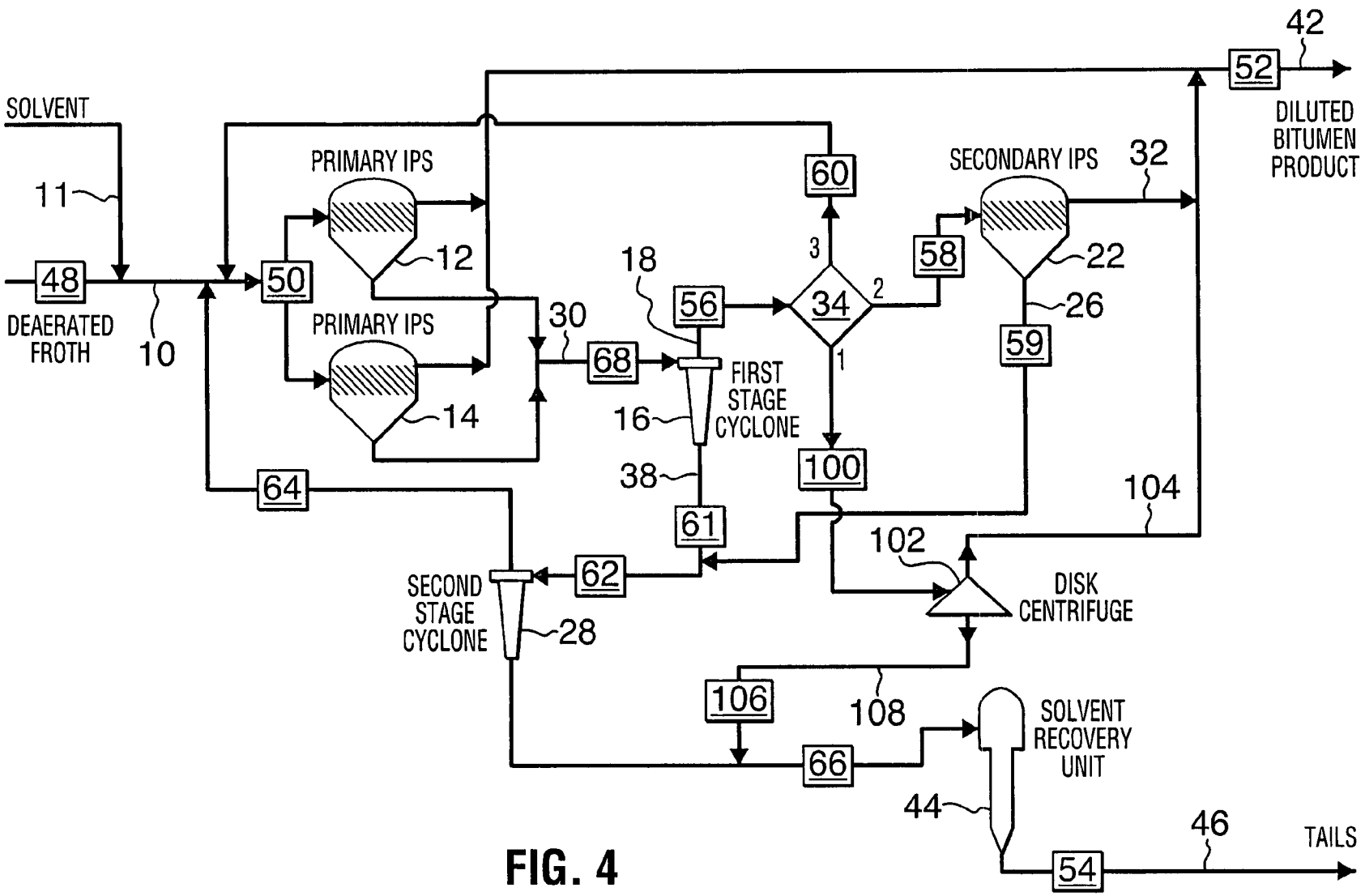
FIG. 4 is a schematic diagram depicting another preferred arrangement of apparatus adapted to carry out the process of the invention.

FIG. 4 is a schematic diagram depicting another preferred arrangement of apparatus adapted to carry out the process of the invention. As with FIG. 1, the schematic diagram provides an outline of the equipment and the process flows, but does not include details, such as pumps that provide the ability to transport the process fluids from one unit to the next. The apparatus of the invention includes inclined plate separator (IPS) stage units and cyclone stage units and centrifuge stage units, each of which process an input stream to produce an overflow output stream, and an underflow output stream. The centrifuge overflow output stream has a bitumen enriched content resulting from a corresponding decrease in solids, fines and water content relative to the bitumen content of the centrifuge input stream. The centrifuge underflow output stream has solids, fines and water with a depleted bitumen content relative to the centrifuge input stream. The centrifuge underflow output stream may be referred to as a bitumen depleted stream.

In the general arrangement of the apparatus adapted to carry out the process, inclined plate separator (IPS) units are alternately staged with either cyclone units or centrifuge units such that an IPS stage underflow feeds a cyclone stage or a centrifuge stage or both a cyclone stage and a centrifuge stage. In addition a cyclone stage overflow or a centrifuge stage overflow is sent to product or feeds an IPS stage. This circuit enables one to take full advantage of centrifuges that might be destined for replacement. In another sense it provides a fallback to the circuit depicted in FIG. 1.

In FIG. 4, the same reference numerals are used to depict like features of the invention. The processing circuit has a circuit inlet 10 to receive a process feed stream 48. The process feed stream is a deaerated bitumen froth output of an oil sands extraction process and is diluted at 11 with a suitable solvent, for example naphtha, or a paraffinic or alkane hydrocarbon solvent. The diluted bitumen feed stream 50 including a recycle streams 60 and 64 is supplied to a primary IPS stage comprising IPS units 12 and 14 shown as an example of multiple units in a process stage. The overflow output stream 52 of the primary IPS stage is supplied as a product stream, which is sent to the circuit product outlet line 42 for downstream processing, for example at an upgrader plant.

The underflow output stream of the primary IPS stage is supplied via line 30 as the feed stream 68 to a primary hydrocarbon cyclone stage (HCS) comprising for example, a primary cyclone 16. The hydrocarbon cyclone processes a feed stream into a bitumen enriched overflow stream and a bitumen depleted underflow stream. The overflow output stream 56 of the primary cyclone stage on line 18 is directed for further processing depending on the setting of diverter valve 34. Diverter valve 34 is adjustable to direct all or a portion of the primary HCS overflow output stream 56 to a recycle stream 60 that is carried on line 3 to become a recycle input to the feed stream 50 supplied to the primary IPS stage. The portion of the primary HCS overflow output stream that is not directed to recycle stream 60 can become all or a portion of either the secondary IPS feed stream 58 that is delivered to a secondary IPS stage 22 via line 2 or a centrifuge stage feed stream 100 that is delivered to a centrifuge stage 102 via line 1. Naturally diverter valve 34 can be set to divert all of the HCS overflow stream 56 either to the secondary EPS feed stream 58 or to the centrifuge stage 102.

When paraffinic solvents are deployed asphaltene production will occur. Under these circumstances the first stage cyclone underflow stream 61 can be configured separate from the second stage cyclones to provide two separate tailings paths for asphaltenes. On the other hand, asphaltene production is very low when naphtha based solvents are deployed in this process and, consequently, two separate tailings paths are not required.

Adjustment of diversion valve 34 permits the processing circuit flows to be adjusted to accommodate variations in oil sands ore composition, which is reflected in the composition of the bitumen froth feed stream 48. In this manner, the circuit process feed flow 50 to the primary cyclone stage can be set to adapt to the processing requirements providing optimal processing for the composition of the bitumen froth feed. In some circumstances, such as when the capacity of the secondary IPS stage 22 and centrifuge stage 102 is exceeded, all or a portion of the primary cyclone stage overflow stream 56 on line 18 is directed to recycle stream 60 by diverter valve 34.

The preferred embodiment of a process circuit in accordance with the principles of the invention preferably includes secondary IPS processing equipment or centrifuge processing equipment interconnecting with the primary stage processing equipment by means of diverter valve 34. Where the entire overflow output stream of the primary stage is recycled back to the primary IPS stage, the primary IPS stage process acts as a secondary IPS stage and no stream is supplied to the secondary IPS stage or the centrifuge stage for processing. However, a secondary IPS stage or centrifuge stage or both is preferably provided to accommodate the variations in composition of the feed froth stream 48 encountered in operation of the process. Secondary IPS unit 22 processes the feed stream 58 received from the overflow of the primary cyclone stage into a bitumen enriched secondary IPS overflow output stream on line 32 and a bitumen depleted secondary IPS underflow output stream 59 on line 26. The recovered bitumen of the secondary IPS overflow stream on line 32 is combined with the overflow stream of the primary IPS stage to provide the circuit output bitumen product stream 52 delivered to the circuit product outlet line 42 for downstream processing and upgrading. The centrifuge stage unit 102 processes the feed stream 100 received from the overflow of the primary cyclone stage into a bitumen enriched centrifuge output stream on line 104 and a bitumen depleted centrifuge underflow output stream 106 on line 108. The recovered bitumen of the centrifuge overflow stream on line 104 is supplied to the circuit output bitumen product stream 52, which is delivered to the circuit product outlet line 42 for downstream processing and upgrading.

The secondary stage IPS 22 underflow output stream 59 is processed in this embodiment in the same manner as in the embodiment depicted in FIG. 1. The secondary HCS underflow output stream and the centrifuge output stream 106 are combined to form stream 66, which is directed to a solvent recovery unit 44. The solvent recovery unit 44 processes stream 66 to produce a circuit tailings stream 54 that is provided to the circuit tails outlet 46 of the circuit. The solvent recovery unit (SRU) 44 is operated to maintain solvent loss to the tailings stream 54 between 0.5% to 0.7% of the total solvent fed to the circuit at 11. The tailings stream 54 is sent for disposal on the circuit tails outlet line 46.

The closed loop nature of the recycling of this process reveals two recycling loops. One recycling loop is closed through line 3 from the primary IPS stage and primary HCS. Another recycling loop is closed from line 2 through the secondary IPS stage via line 26 and through the secondary HCS 28 via stream 64. The feed to the disk centrifuges on line 1 does not provide a recycle loop; thus material sent to the disk centrifuge stage is not recycled back to the primary IPS stage. The HCS unit flow rates and pressure drops are maintained at a level that achieves the performance stated in Tables 1 and 2. An input stream of a cyclone is split to the overflow output stream and the underflow output stream and the operating flow rates and pressure drops will determine the split of the input stream to the output streams. Generally, the range of output overflow split will vary between about 50% to about 80% of the input stream by varying the operating flow rates and pressure drops.

Although a preferred and other possible embodiments of the invention have been described in detail and shown in the accompanying drawings, it is to be understood that the invention in not limited to these specific embodiments as various changes, modifications and substitutions may be made without departing from the spirit, scope and purpose of the invention as defined in the claims appended hereto.

We claim:

1. A process for separating bitumen from a bitumen feed comprising a mixture of bitumen, water and mineral, the process comprising: a) supplying said bitumen feed to an inclined plate separator (IPS) to produce an IPS overflow comprising a first bitumen rich stream and an IPS underflow comprising a first bitumen lean stream; b) supplying said IPS underflow to a cyclone to produce a cyclone overflow comprising a second bitumen rich stream and a cyclone underflow comprising a second bitumen lean stream; and, c) recycling said cyclone overflow for blending with the feed to said IPS.

2. The process of claim 1 wherein said bitumen feed comprises a bitumen froth formed by an oil sands extraction process.

3. The process of claim 2 wherein said bitumen froth is treated in a second inclined plate separator (IPS) prior to being introduced into said cyclone.

4. The process of claim 3 wherein an underflow of said second IPS is introduced into said cyclone.

5. The process of claims 1 wherein said bitumen feed is diluted with a solvent.

6. The process of claim 5 wherein said solvent is naphtha.

7. The process of claim 1 wherein said first bitumen rich stream of said IPS is coupled to a bitumen product stream.

8. The process of claim 1 wherein said first bitumen rich stream of said IPS is coupled to a bitumen product stream.

* * * * *